US010427115B2

(12) United States Patent
Hideaki Kuada

(10) Patent No.: US 10,427,115 B2
(45) Date of Patent: Oct. 1, 2019

(54) AGROCHEMICALS PRE-DILUTION UNIT

(71) Applicant: FMC Quimica Do Brasil Ltda., Campinas-SP (BR)

(72) Inventor: Douglas Hideaki Kuada, Itupeva (BR)

(73) Assignee: FMC QUIMICA DO BRASIL LTDA.

( * ) Notice: Subject to any disclaimer, the term of this patent is extended or adjusted under 35 U.S.C. 154(b) by 683 days.

(21) Appl. No.: 14/891,140

(22) PCT Filed: May 15, 2014

(86) PCT No.: PCT/BR2014/000157
§ 371 (c)(1),
(2) Date: Nov. 13, 2015

(87) PCT Pub. No.: WO2014/183181
PCT Pub. Date: Nov. 20, 2014

(65) Prior Publication Data

US 2016/0096154 A1 Apr. 7, 2016

(30) Foreign Application Priority Data

May 16, 2013 (BR) ..... 1020130122491

(51) Int. Cl.
*B01F 5/00* (2006.01)
*B01F 5/10* (2006.01)
(Continued)

(52) U.S. Cl.
CPC ..... *B01F 5/108* (2013.01); *B01F 3/1271* (2013.01); *B01F 13/1066* (2013.01);
(Continued)

(58) Field of Classification Search
CPC ..... B01F 2215/0009; B01F 5/108; B01F 3/1271; B01F 13/1066; B01F 15/00136;
(Continued)

(56) References Cited

U.S. PATENT DOCUMENTS 4,171,710 A * 10/1979 Boynton ..... A01M 7/0092 137/238
6,302,161 B1 10/2001 Heller et al.
(Continued)

FOREIGN PATENT DOCUMENTS

BR P11100233 3/2013
WO 9315828 8/1993

OTHER PUBLICATIONS

International Search Report, Application No. PCT/BR2014/000157, dated Jun. 24, 2014.
(Continued)

*Primary Examiner* — Anshu Bhatia

(57) ABSTRACT

The invention relates to an agrochemicals pre-dilution unit comprising a mixing device that receives and mixes water and agrochemical. This unit carries out the mixing process by means of a plurality of pumps in fluid communication with the mixing device, which sends the prepared mixture a tank truck through outlet pipes. A plurality of bulks are installed in the unit and contain agrochemicals that are pumped in a controlled and precise manner to the mixing device, allowing a mixture of agrochemicals and water to be prepared with minimum human intervention.

Also disclosed is the preparation of the liquid mixture controlled by a PLC, which enables an operator to obtain an accurate mixture without needing to intervene directly in the unit, since the operator can interact with the unit by means of a computer, such that such that the PLC controls all the devices in unit in order to prepare the mixture.

8 Claims, 4 Drawing Sheets

(51) Int. Cl.

| | |
|---|---|
| ***B01F 13/10*** | (2006.01) |
| ***B01F 3/12*** | (2006.01) |
| ***B01F 15/00*** | (2006.01) |
| ***B01F 15/02*** | (2006.01) |
| *B01F 3/08* | (2006.01) |

(52) U.S. Cl.
CPC .. *B01F 15/00136* (2013.01); *B01F 15/00162* (2013.01); *B01F 15/026* (2013.01); *B01F 15/0243* (2013.01); *B01F 2003/0896* (2013.01); *B01F 2003/125* (2013.01); *B01F 2215/0009* (2013.01)

(58) Field of Classification Search
CPC ..... B01F 15/00162; B01F 15/0243; B01F 15/026; B01F 2003/0896; B01F 2003/125
See application file for complete search history.

(56) References Cited

U.S. PATENT DOCUMENTS

| | | | | |
|---|---|---|---|---|
| 6,425,529 | B1 * | 7/2002 | Reinsch | A01M 7/0092 239/10 |
| 7,093,606 | B2 * | 8/2006 | Roberts | A01C 23/042 137/14 |
| 2007/0036024 | A1 * | 2/2007 | Kubala | B01F 5/043 366/163.2 |
| 2013/0286767 | A1 * | 10/2013 | Gaultney | B01F 1/0022 366/152.2 |

OTHER PUBLICATIONS

International Written Opinion, Application No. PCT/BR2014/000157, dated Jun. 20, 2014.

* cited by examiner

AGROCHEMICALS PRE-DILUTION UNIT

CROSS REFERENCE TO RELATED APPLICATIONS

This application is a U.S. nationalization under 35 U.S.C. § 371 of International Application No. PCT/br2014/000157, filed May 15, 2014, which claims priority to Brazil Application No. 10 2013 012249 1, filed May 16, 2013.

The present invention relates to an agrochemical pre-dilution unit that allows the preparation of a mixture of water with agrochemicals without direct interaction by a worker, thus minimizing labor hazards and environmental impacts.

DESCRIPTION OF THE PRIOR ART

The application of agrochemicals is common practice in the food industry and other types of biomass crops. Although there is a current trend to reduce the use of such chemicals, since they can be harmful to human health, their use is required, for instance, for a proper handling and treatment of crops or plantations.

The application of agrochemicals is usually different for each of the necessary indications and specifications that are chosen or indicated by an operator with knowledge of the cultivation and treatment to be carried out. Indeed, the application of agrochemicals also follows the manufacturer's indication and specification. However, the final decision of what should be applied, how and when it will be used is the operator's responsibility of an agricultural farm or plantation, that is, the operator with specific expertise chooses the type of agrochemical to be applied so that a worker can perform the specific mixture chosen by the operator.

Usually, the worker does not have technical and specific expertise when compared to the operator of the agricultural farm or plant.

By way of example, the application can be carried out on a farm for planting cotton, soybean, or sugar-cane.

The agrochemicals employed in such an industrial sector can be of the most varied types possible, some being more harmful to humans and other less harmful, but it should be observed that all these products to a greater or lesser extent can cause undesired results to man, and mainly the environment in which the respective application takes place, if handling of the agrochemical is not correct.

Thus, in order to minimize any undesired impacts or are harmful to human health, mainly the health of the operator that handles the agrochemical, protective equipment should be used. The equipment that the operator uses or should use in order to meet the safety standards are known as PPE (Personal Protective Equipment), which are made of protective clothing, gloves and chemical resistant boots and masks with filtering agents, so that the operator will not inhale solvents or other volatile compounds. It is important to emphasize that agrochemicals supplied to farms and plants have a high degree of concentration and therefore must be diluted—for its implementation—especially when used in ground spraying. In air spraying, that is, from airplanes applying agrochemicals, dilution also takes place, but the concentration of the mixture is respectively higher, since the transportation capacity is smaller and more expensive.

As already mentioned, before applying the agrochemical mixture with a sprayer, the mixture is diluted with water to form a syrup. This syrup is exactly a mixture of a composition of at least one agrochemical together with a preestablished amount of a solvent, which is water. Thus, the syrup is prepared in large containers that can withstand substantial amounts of agrochemicals as well as solvent. Usually, such containers range from 5,000 to 20,000 liters in capacity and are located, for instance, in a shed of the property or farm. Following the preparation of the solution (pre-dilution), it is transported by tank trucks to the sprayer that may be in the field or on a runway (in case of air spraying).

The sprayers, besides being supplied with said syrup, are usually supplied with additional water for the respective application of the syrup in the field.

In practice, the worker is often pressed to perform the preparation of the syrup in the cited containers under pressure conditions and with a significant amount of agrochemical. In other words, the worker has to prepare the syrup to be supplied to the tank trucks on a relatively short-time interval.

Thus, the possibility of incurring error in the applications is of major consequence. The most common consequence of an error by the worker is directly linked to a greater waste of agrochemical, as well as exposure of the worker to the agrochemical. This often occurs in practice, despite being wearing the appropriate equipment.

In addition, because the syrup is prepared in a large tank located in a shed, the atmosphere can be impregnated with the volatility of the syrup being prepared, or even to be a direct contact of the people transiting with the agrochemical.

Moreover, several incidents may occur in the handling of agrochemicals. In short, the current handling of agrochemicals for preparing the syrup is relatively rudimentary, requiring interference or direct user interaction with the agrochemical. This also exposes the worker/user to hazards that can be substantially aggravated upon an incorrect or unintentional handling. The health consequences are significant and the respective labor responsibility cannot be disregarded.

Also, it cannot be ruled out the fact that the time for preparing the syrup is quite significant, as well as the fact that there is no precise control of the amount of agrochemical and water that was used by the worker to prepare the syrup.

In other words, in spite of the correct practices, the operator of a plant does not have absolute control over what is being done in practice, since it depends on the worker.

In some cases, it is difficult to know if part of the agrochemical was subtracted upon preparation of the syrup. This is because there is, even if remote, the possibility of the worker using a smaller amount of the agrochemical for the specific solution, without the operator having this knowledge. This not only relates to a criminal act, but it is also too harmful to the efficient production of the plant or farm, since the operator understands that a certain amount of agrochemical was sprayed in a certain location when, in fact, it was not.

In the prior art there is a transportation device which avoids the abovementioned drawbacks. Such a device is the object of document PI1100233-6, which relates to a truck that performs the whole mixture of the syrup, besides transporting the syrup to the sprayer.

The object of document PI1100233-6 is quite efficient and has met the various demands of the agroindustry, proving to be an important tool for plants and farms that make use of agrochemicals. However, this truck (PI1100233-6) is directed to a few specific applications. Thus, there is the need that each truck be equipped with pumps, transporting bulks to the field, etc. Indeed, this may raise the production cost of the plant, because, in spite of being a transportation device it is also a device for mixing agrochemicals.

Therefore, since there is the need to employ a plurality of these devices at a plant, that would certainly increase the production costs, since each truck has a range of equipment.

Thus, in practice, one has often chosen for carrying out the mixture (syrup preparation) in sheds, as indicated above, and transporting the syrup as far as the respective sprayer by means of tank trucks.

So, there is a certain limitation of the amount of syrup that can be prepared in the same plant, if one chooses for the solution indicated in document PI1100233-6;

BRIEF DESCRIPTION OF THE INVENTION

The present invention relates to an agrochemicals pre-dilution unit. In this unit there is a mixing device that mainly accounts for mixing agrochemicals with water to prepare a syrup to be sprayed on the field. To this end, this unit is provided with a pump for circulating water and/or agrochemical inside and another pump for communicating the mixing device with the outlet pipe of a mixture of water with agrochemical.

Besides, the unit is also provided with a dosing pump, which is intended to fill a tank truck. This dosing pump has a flow-rate capacity of about 50 $m^3$/h. Thereby and taking into account that a tank truck has approximately 14,000 liter capacity, the expected time to fill the tank truck completely is only 14 minutes.

In this unit bulks are provided which are connected to the inlet of the pump for circulating water and/or agrochemical through respective pipes having pressure sensors, so that one can determine the amount of agrochemical passing through the pipes. The outlet of this same pump communicates with the mixing device through another pipe to supply agrochemical coming from the bulks to said mixing device.

Thus, it is possible to carry out the whole operation of mixing agrochemicals in the unit, without direct interaction of a worker and, at the same time, the operator has the assurance of the quality and accuracy of the syrup being produced.

BRIEF DESCRIPTION OF THE DRAWINGS

The present invention will now be described in greater detail with reference to an example of embodiment represented in the drawings. The figures show.

DETAILED DESCRIPTION OF THE FIGURES

Figure 1:
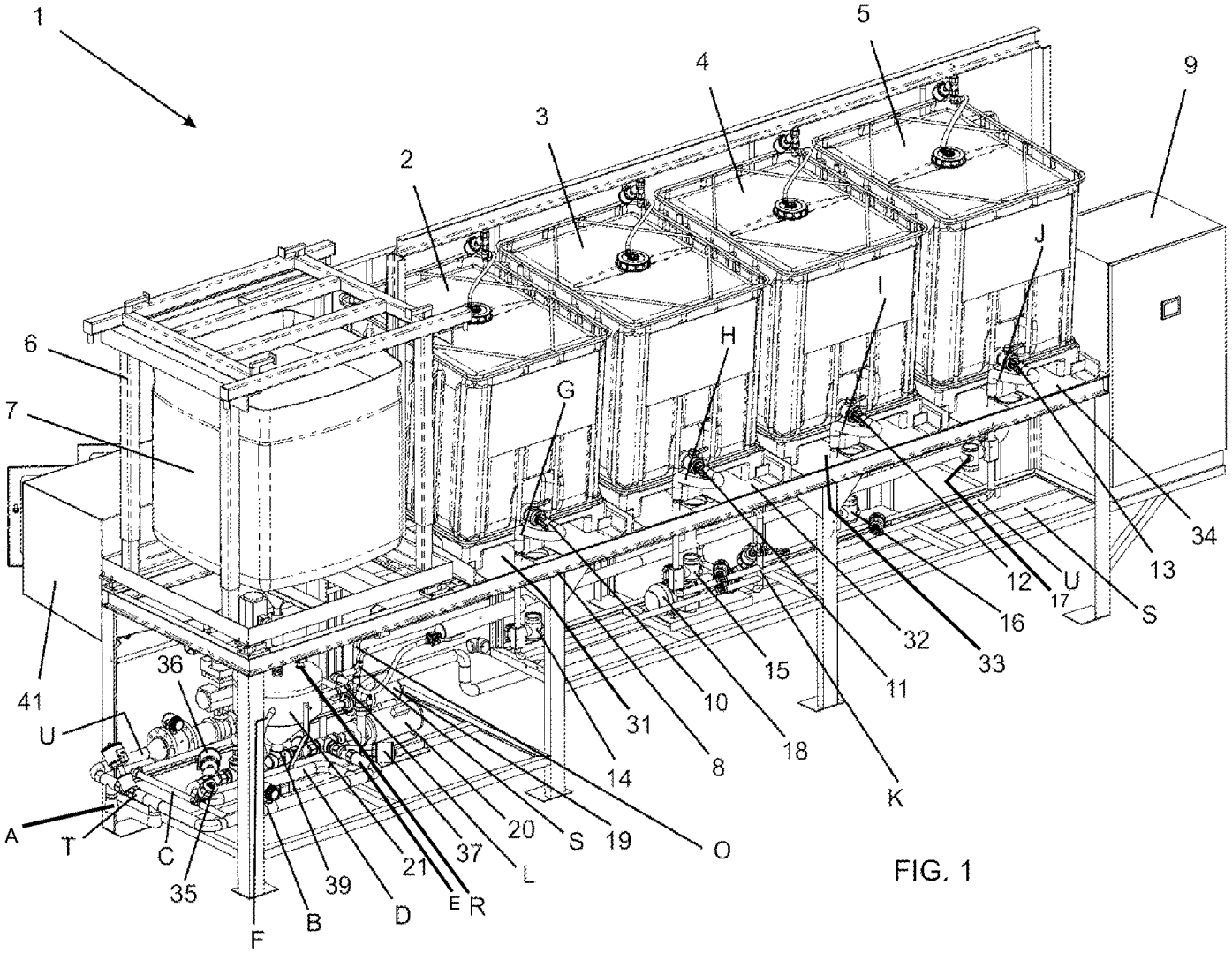
FIG. 1 is a perspective view of an agrochemicals pre-dilution unit.

As can be seen in the above-indicated figures, mainly in FIG. 1, an agrochemicals pre-dilution unit 1 is represented in a perspective view. In the embodiment of the present invention, there are four bulks 2, 3, 4 and 5, which are containers filled with agrochemicals.

These bulks come from the agrochemical manufacturer and are sent to a farm or plant for combating pests, etc. They generally have a volume of approximately 1,000 L. Thus, in view of the size and weight of the bulks, they are usually moved within a shed of a plant by means of equipment that allows handling them such as, for instance, a forklift.

These bulks 2, 3, 4 and 5 can be removed or placed on a support structure 8 of the agrochemicals pre-dilution unit 1 independently, that is, when it is necessary to replace one of the bulks by another, the worker has only to disconnect it from said unit 1 and place another bulk (if necessary) on the support structure 8.

Figure 2:
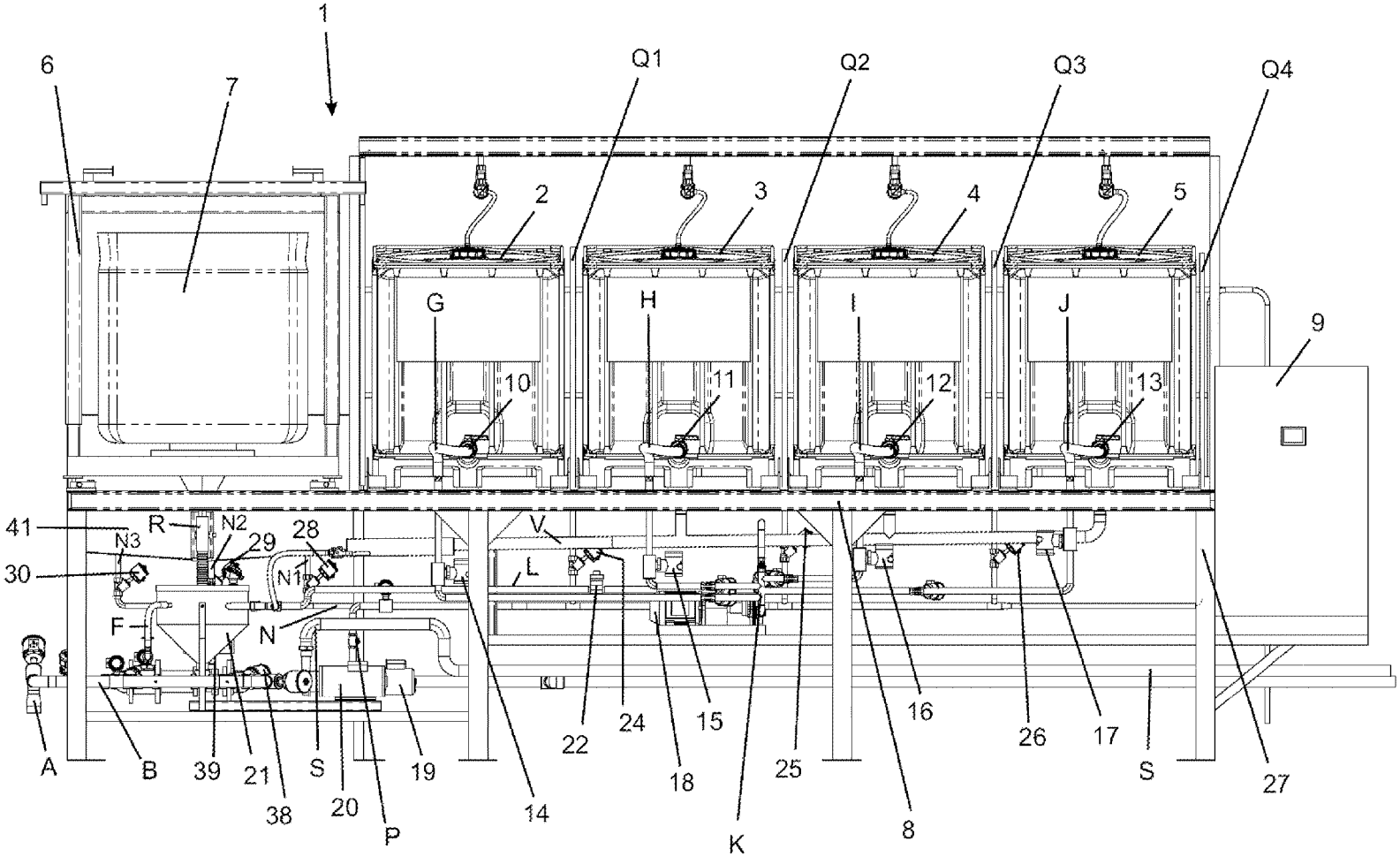
FIG. 2 is a front view of the agrochemicals pre-dilution unit.
Figure 3:
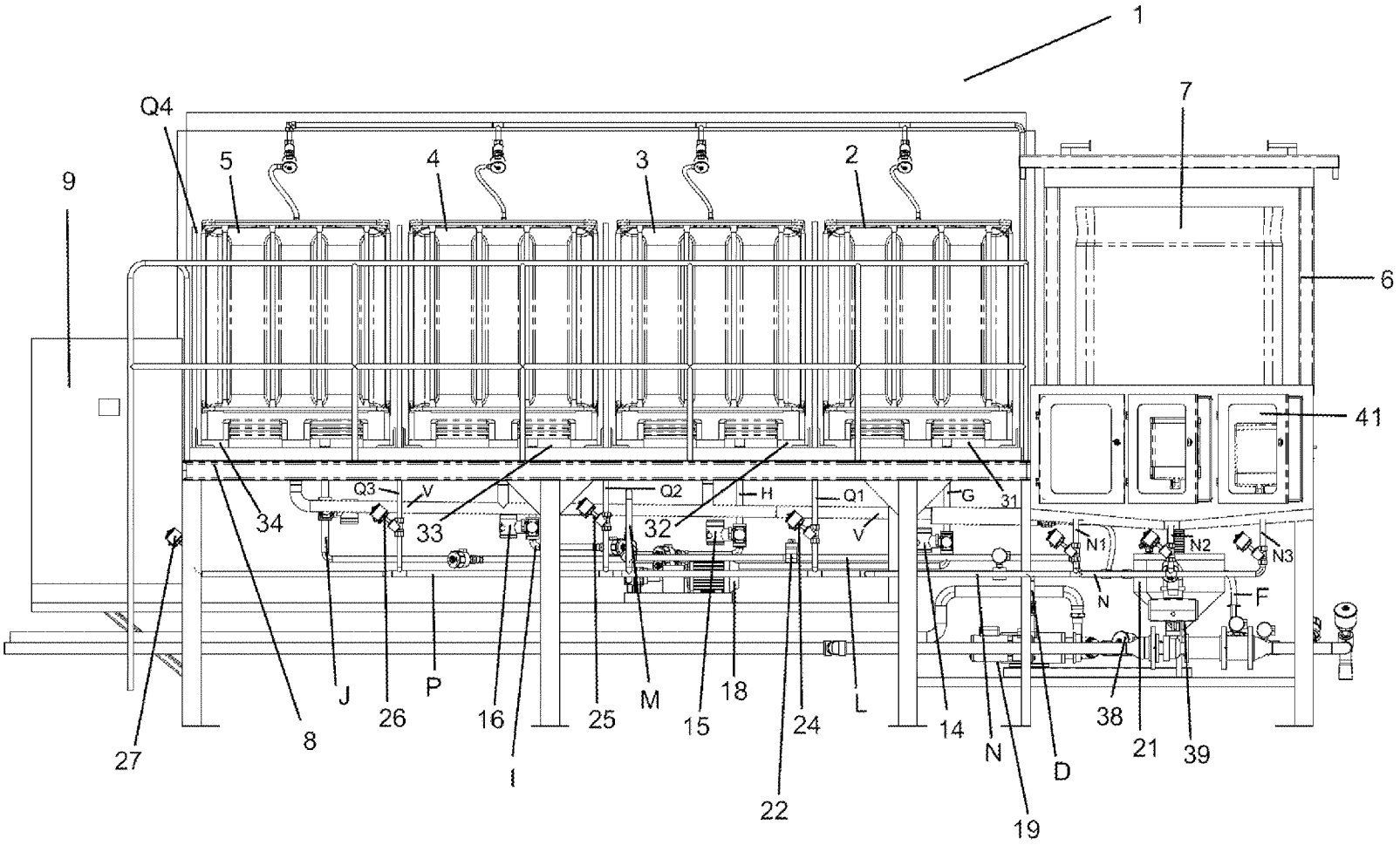
FIG. 3 is a back view of the agrochemicals pre-dilution unit.
Figure 4:
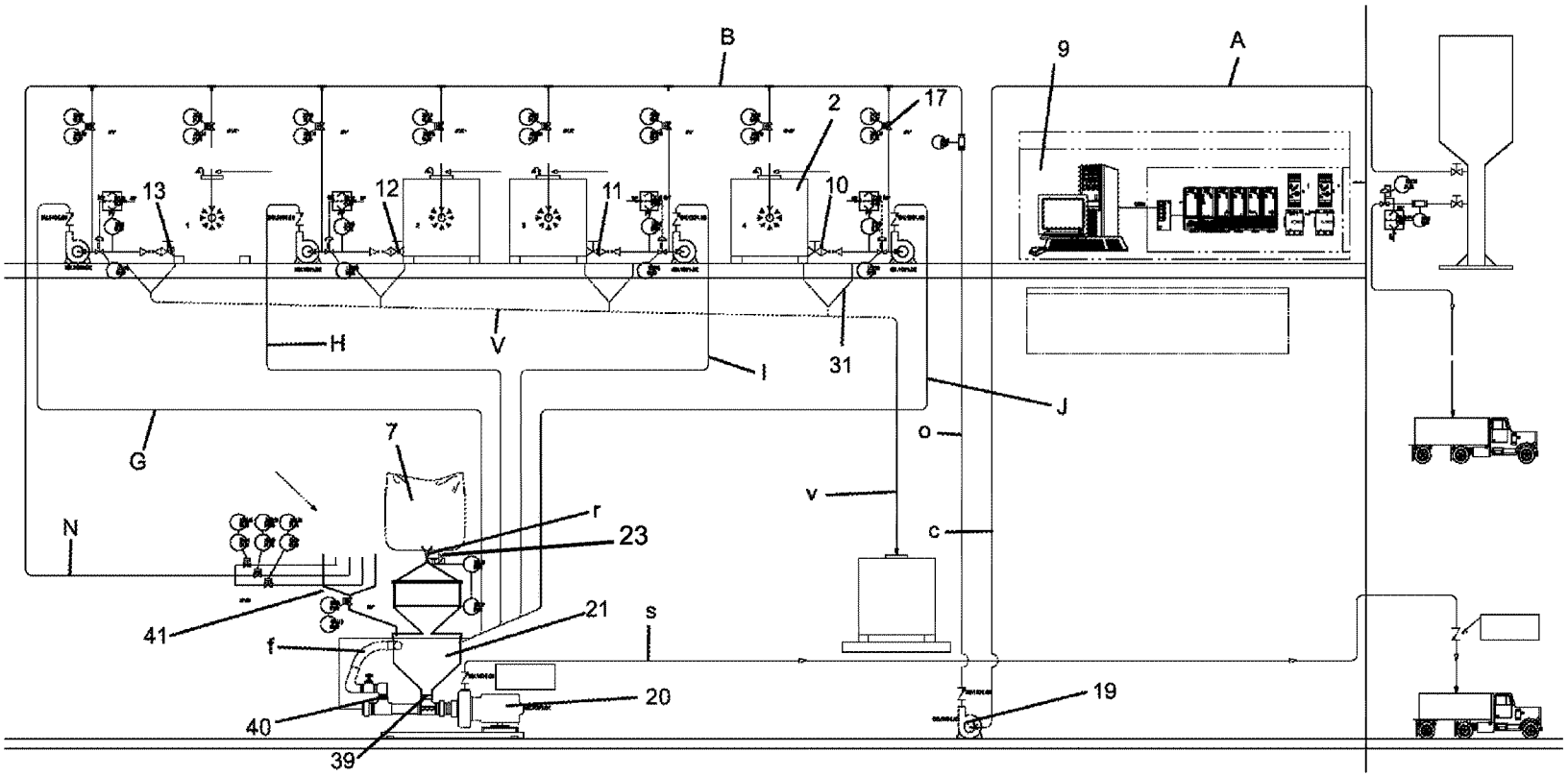
FIG. 4 is a schematic view of the connections of the agrochemicals pre-dilution unit.

In FIG. 1 (and consequently in FIGS. 2, 3, and 4), one can further notice that bulks 2, 3, and 4 are located at an upper portion of the structure 8 and that in the lower portion of this structure there is a plurality of pipe and equipment that communicate and interact with each other for the purpose of producing syrup for a tank truck which transports, for instance, the content of the bulks diluted in water, namely, the syrup required to be delivered to their sprayer in the field.

Further in a left and upper portion of the structure 8 there is a bag of powdered inputs 7, which contains agrochemicals that should be added to the syrup for certain demands which are chosen by the operator of unit 1. This choice takes place through a PLC that is accommodated in a PLC housing 9, and it can be performed near unit 1 or remotely. Explanation: since the equipment of the present invention (as will be shown below) are interconnected with each other, it is necessary that a plurality of valves, pumps and pipe be interconnected to the production of syrup in an optimized manner. In this regard, in the object of the present invention these devices are connected to the PLC, so that the operator can operate the whole unit by means of a computer. This can even be done remotely.

Anyway, it is observed that each of the bulks 2, 3, 4 and 5 have respective outlets 10, 11, 12 and 13. Indeed, these outlets 10, 11, 12, and 13 are valves that communicate with respective flexible pipes G, H, I, J. Thus, when a bulk needs to be replaced, the valve of the respective flexible pipe is closed, interrupting the fluid communication. The bulk is replaced so that the flexible pipe can be connected again, thus opening said valve.

As can be observed, each of the flexible pipes G, H, I, J receive agrochemical from each of the bulks and communicate at a central portion of the unit 1 with a collector K, which joins all these flexible pipes G, H, I, J in a single pipe. However, it should be noted that, prior to assembling the pipes, each of the flexible pipes G, H, I, J has a respective pressure sensor 14, 15, 16 and 17, which are below the bulks 2, 3, 4 and 5. Considering the column formed by the difference in height between outlets 10, 11, 12 and 13 and the pressure sensors 14, 15, 16, and 17, it is possible to measure the pressure on said sensors, so as to determine the amount of agrochemical or liquid present within each of the bulks 2, 3, 4, and 5. This information is read on each of the pressure sensors 14, 15, 16 and 17 and sent to the PLC.

Thus, after the agrochemical present in each of the bulks 2, 3, 4 and 5 pass through said pressure sensors 14, 15, 16, and 17, it goes into the collector K before being sucked by a dosing pump 18, which has its inlet connected to the collector K.

In the figures one can further observe that the collector K is connected to a pipe M, which is in fluid communication with a backwash pump 19, the inlet of which communicates with a source of water. Thus, it is possible for the water to be added to the collector K, which may be pumped by the dosing pump 18.

The outlet of the dosing pump 18 runs in the direction of the mixing device 21 through the pipe L, and a flow-rate meter 22 is installed on this pipe, the information of which are read by the PLC.

Thus, when the agrochemical present in each of the bulks cited is sucked by the dosing pump 18, it is possible for the PLC to measure the exact amount of agrochemical that was supplied to the mixing device 21. Indeed, upon controlling the opening of the pressure sensors 14, 15, 16 and 17, which also have the function of stopping the respective flow of agrochemical in the flexible pipes H, H, I, J, the PLC programmed by the operator the necessary opening time for each of the pressure sensors 14, 15, 16 and 17 is determined. Thus, when measured by the flow-rate meter 22, the amount of agrochemical that has passed through pipe L coming from the flexible pipes G, H, I, J, the PLC stops the flow of agrochemical by closing the respective sensor and is also able to turn off the pump at the desired moment.

Indeed, a quite accurate amount of agrochemical is supplied to the mixing device 21, without having any contact of the worker with the contents of bulks 2, 3, 4, and 5. There is only the command of the operator to the PLC, which acts to turn or/off the equipment involved in the transportation of agrochemical to the mixing device 21. Exemplifying what has been set forth: the operator, through PLC software, inputs the necessary information on the type of solution that should be prepared. The PLC, which has information about the necessary measurements, and thereby activates the functioning of the dosing pump 18 and also releases the flow of agrochemical from one of bulks 22, 3, 4, and 5. Therefore, there is only minimum interaction of the operator with unit 1 for the preparation of the solution, which is made through the PLC, that is, the operator can choose and prepare the desired solution by only accessing a computer.

Besides, the interaction of the worker is related only to the replacement of the bulks in unit 1 and to the connection of the outlet pipe S to a tank truck, which will be responsible for the distribution of syrup from unit 1 to the sprayers that act in the field. Obviously, there are still other characteristics of the present invention that will be described below.

As can be observed in the figures, the backwash pump 19, besides supplying additional water to the collector K, has a pipe O that is subdivided into three, namely: pipe M, which supplied water to the collector K, pipe P, which supplies water to four upper pipes Q1-Q4, and pipe N, which supplies water to three fractionated pipes N1-N3.

The supply of water from the backwash pump 19 to the collector K through the pipe M is controlled by the PLC, which, in determined operations, supplies a pre-mixture of agrochemical with water to the mixing device 21. This supply of water can be totally disabled by the PLC or, when necessary, it can be quite accurate, so that the volume of water supplied to the collector K is monitored. In addition to this pre-mixing function, this supply of water is intended to clean the respective pipe that is downstream the backwash pump 19.

Indeed, when there is supply of water from the backwash pump 19 to the pipe P, which is divided into four upper pipes Q1-Q4, there is no longer the preparation of syrup per se. Since the object of this supply of water is the interior of each of the respective bulks 2, 3, 4 and 5, each of the upper pipes Q1-Q4 communicates respectively with one of bulks 2, 3, 4 and 5. Thus, for instance, when the content of one of the bulks is in the end or even finished, it is desirable that the remaining agrochemical in the respective bulk is totally removed from it. Because it is, naturally, desired that the bulks are transported cleaned to the manufacturer/supplier of agrochemicals, so as to minimize any unwanted contamination that might be within the bulk.

In addition, since the contents of each of bulks 2, 3, 4 and 5 is independent, in order to prevent water from the backwash pump 19 from getting into bulks 2, 3, 4 and 5 through pipes Q1-Q4, mixing the agrochemical in an undesired manner, flow shut-off valves 24, 25, 26, 27 are added, which close the pipe and prevent the passage of water into the bulk still filled with agrochemical.

In this regard, for instance, the backwash pump 19 is actuated by the PLC, supplying water to pipe P, which in turn provides water to upper pipe Q1, activating the flow shut-off valves 25, 26, 27, which interrupt pipes Q2-Q4, presenting the passage of water into bulks 3, 4, 5. The communication of the upper pipe Q1 with bulk 2 is made by means of a cover that is on the upper part of bulk 2, which has, on its face turned to the inside of the bulk, a water dispenser (not shown) that provides a jet of water that reaches the whole inner part of bulk 2. In this way, one guarantees that any remaining agrochemical will be led to the outlet of bulk 10, this mixture resulting from cleaning the bulk being used for producing the solution.

As can be understood, there is no waste of agrochemical during the preparation of the syrup in unit 1 of the present invention. This is because even any residue of agrochemical that remains in the respective bulk is used for preparing the syrup. In addition, it is important to point out again that this cleaning and optimization of use of the agrochemical is carried out without any direct interference of the worker. This procedure can be carried out automatically, so that the PLC can eventually send a signal or even a message to both the operator and the worker, informing that bulk cleaning step is being carried out and that the bulk will be replaced soon.

One of the main objects of the present invention is minimization of any undue impact the agrochemical may have on the environment. In this regard, although all the connections present on the bulks are of high quality, it is at this place that there is more interaction during the operation of unit 1. This is because, as shown above, it is necessary to replace the respective bulk that is empty. In this way the worker still has a minor indirect interaction with the agrochemical that is inside the bulk to be replaced or in the new filled bulk to be placed on the support structure 8. During this replacement the empty bulk is disconnected at its upper portion, since the cover that is connected to the upper pipe (for example, Q1) should be disconnected as well as the bulk outlet (for example, 10). During this operation and although the worker takes the necessary security measures, in some cases a dripping of agrochemical may take place from these connections, which are being released and reconnected. Therefore, since there should not be any type of contamination of agrochemical that may fall on the place where unit 1 is installed, respective collecting chutes 31, 32, 33 and 34 are provided under each of bulks 2, 3, and 4, which extend beyond and under the whole extent of the respective bulks.

Indeed, collecting chutes 31, 32, 33, and 34 are a sort of support on which bulks 2, 3, 4 and 5 can be placed, and they have the shape similar to a hopper or a funnel, so that when tapering downward its section is decreased as far as each one is fitted into a pipe V that communicates with the discharge line of the product dosing pump. In turn, the pressure-pump line is connected to the mixing device 21. In this regard, any undesired dripping from bulks 2, 3, 4 and 5, when these are placed on the support structure 8, flows by gravity until they are collected for due processing or disposal, so as to prevent any undesired contamination. The way traversed by the leaked agrochemical is allowed through pipe V, since the latter has a downward inclination that can be clearly observed in FIG. 2, where one can see that the inclination is towards the mixing device 21.

It should be pointed out that the damages can be the most varied possible, as for example a crack in the bulk wall or circumstances caused by undesired procedures that take place in accidents. The important thing is that through the characteristics set out above that the pre-dilution unit 1, besides providing the possibility of preparing the syrup with a minimum interference of the worker, who does not have direct contact with the agrochemicals, also prevents contamination for unforeseen situations while handling the bulks that contain agrochemicals.

The water that is supplied to the mixing device 21 may also come from pipe A, which is connected to a source of water, as for example a tank. Thus, water is pumped to this pipe A, which is subdivided into two pipes, the first division being pipe C, which supplies water to the backwash pump 19, the function of which was described before. It should be noted that the fluid communication between pipe A and pipe C may be stopped by a shut-off valve 35, which is actuated or released by the PLC.

In turn, the second division is pipe B, which is also subdivided into pipe D and pipe E, both pipes D and E having respective shut-off valves 36, 37, which are also commanded by the PLC. In this way, by opening/closing the shut-off valves 36, 37, one can lead the flow of water from pipe B to pipe D or pipe E.

When the water is supplied by pipe E, the latter could communicate with the inlet of the dosing pump 20, which in turn has its outlet connected to said outlet pipe S, which provides liquids that pass through said dosing pump 20 to a tank truck.

However, as can be seen in the figures, the inlet of the dosing pump 20 is also in fluid communication with pipe D. thus, in order to prevent the water that is passing through pipe E from flowing back to pipe D, a further shut-off valve 38 is provided, which is also commanded by the PLC.

Therefore, if there is the need to provide, for instance, only water to the tank truck, during the actuation of dosing pump 20 the shut-off valves 35, 36, and 38 should remain closed, while shut-off valve 37 remains open.

However, during the pumping of the dosing pump 20, when the valves 35 and 37 are closed, shut-off valves 36 and 38 should remain open so that there will be fluid communication between pipe A and dosing pump 20. Once again it should be stressed that the opening and control of said valves and the actuation of the pumps are commanded by the PLC. However, in the latter configuration of opening valves, the water from pipe A communicates with the lower outlet 39 of the mixing device 21 before passing through the dosing pump 20. It is through this lower outlet 39 that the liquid (syrup) mixed in the mixing device 21 flows through suction into the dosing pump 20, which, in turn, pumps the duly mixed and homogenized solution to the tank truck through outlet pipe S.

However, if there were only the communication of pipe D through lower outlet 39, the fluid contained in the mixing device 21 would not have sufficient pressure to flow through said outlet toward the dosing pump 20. This is because, under determined conditions, the pressure on pipe D would be greater than the pressure at the lower outlet 39. Thus, in order to enable the pressure within the mixing device 21 to be higher than in pipe D close to the lower outlet 39, there is a kind of by-pass of pipe D itself into the mixing device 21. This by-pass is carried out by pipe F, which communicates a shut-off valve 40 installed in pipe D with the mixing device 21.

Since the shut-off valve 40 is controlled by the PLC, the amount and the pressure of the fluid inside the mixing device 21 can be controlled with respect to the pressure of pipe D close to the lower outlet 39. Thereby, the PLC commands the amount of mixture fluid (syrup) that passes through the dosing pump 20 coming from the mixing device 21.

This connection provided by pipe F also has the function of adding water that is duly homogenized to the contents of the mixing device 21, enabling one to obtain a solution of high quality, that is, a solution which the operator has the possibility of controlling accurately with respect to the proportion and amount of inputs added to it.

It is important to point out that the solution formed inside the mixing device 21 may be composed not only by water and the agrochemical coming from bulks 2, 3, and 5, but also, and depending on the necessary application and respective solution to be produced, by other inputs. In the embodiment of the present invention mixing device 21 is further connected, at its upper portion, to the bag of powdered inputs 7 through pipe R. In this pipe R, there is a shut-off valve 23, which, upon being commanded by the PLC, opens or closes, allowing powdered inputs coming from said bag 7 to be accurately supplied into the mixing device 21. Thus, by means of the existing motion of fluids inside the mixing device 21, the powder added therein is also homogenized to the prepared solution.

However, unlike the case of liquids, it is necessary to provide a balance 6, on which the bag of powdered inputs 7 is installed, so that one can control the amount of powdered inputs that was supplied to the mixing device 21. In this regard, and since the reading of weighing machine 6 is also in communication with the PLC, it is possible that the exact amount of powdered input being provided by the bag of powdered inputs 7 to the mixing device 21 when the shut-off valve 23 is open is registered in the weighing machine. When the amount determined by the operator through his interaction with the PLC is reached, the PLC stops the flow of powder that passes through the pipe R by closing (commanding) the shut-off valve 23.

Finally, in certain conditions, it is desired by the operator that a few other less used agrochemicals should be added to the solution, that is, in certain specific applications it is necessary that a wider variety of agrochemicals be prepared by agrochemical pre-dilution unit 1. For this purpose, it would be necessary to provide a significant plurality of bulks at the unit in question. In the case of the embodiment of the present invention, one can clearly observe that there are four bulks 2, 3, 4 and 5, but if a larger number of bulks were installed at the unit 1, this would obviously increase the price of the unit, besides occupying a significantly larger space.

Thus, in order to minimize the costs of unit 1 and the space occupied by it and, at the same time, still allow the operator to have the possibility of choosing syrups prepared with an agrochemical that is not present in the bulks installed therein, it is provided, in a right portion of unit 1, a fractionated handling compartment 41. In this compartment 41, it is possible for the worker to install a determined amount of smaller packages containing agrochemicals (usually 20 liters). These packages may be connected to respective pipes N1, N2 and N3 coming from a pipe N, which will make the asepsis of the packages after they are poured into compartment 41. Once these products have been dumped, they leave the compartment 41 through the bottom and fall by gravity into mixer 21.

Finally, when necessary, it is possible for the backwash pump 19 to still supply water directly to the tank truck through a pipe U.

As can be seen from the foregoing, there is the possibility of the operator preparing the solution to be used in the field in an accurate manner, controlled by the PLC without the worker having to have direct interaction with the diluted and prepared agrochemical, before it is supplied to the tank truck. Further, it can be observed that unit 1 minimizes drastically the possibility of contamination at the time of preparing the agrochemical, since it is installed at a safe place, is not movable and yet has equipment that prevents contamination even in the case of unexpected leakages.

Having described an example of preferred embodiment, it should be understood that the scope of the present invention encompasses other possible variations, being limited solely by the wording of the appended claims, including therein the possible equivalents.

REFERENCE LIST OF THE DRAWINGS

Pieces of Equipment Belonging to the Pre-Dilution Unit

1—pre-dilution unit
2—bulk
3—bulk
4—bulk
5—bulk
6—scale
7—bag of powdered inputs
8—support structure
9—PLC housing
10—bulk outlet
11—bulk outlet
12—bulk outlet
13—bulk outlet
14—pressure sensor
15—pressure sensor
16—pressure sensor
17—pressure sensor
18—dosing pump
19—backwash pump
20—dosing pump
21—mixing device
22—flow-rate meter
23—shut-off valve
24—shut-off valve
25—shut-off valve
26—shut-off valve
27—shut-off valve
31—collecting chute
32—collecting chute
33—collecting chute
34—collecting chute
35—shut-off valve
36—shut-off valve
37—shut-off valve
38—shut-off valve
39—lower outlet
40—shut-off valve
41—fractionated handling compartment Connections and Joints Between the Equipment of the Pre-Dilution Unit A—pipe
B—pipe
C—pipe
D—pipe
E—pipe
F—pipe
G—flexible pipe
H—flexible pipe
I—flexible pipe
J—flexible pipe
K—collector
L—pipe
M—pipe
N—pipe
N1—fractionated pipe
N2—fractionated pipe
N3—fractionated pipe
P—pipe
Q1—upper pipe
Q2—upper pipe
Q3—upper pipe
Q4—upper pipe
R—pipe
S—outlet pipe
U—pipe
V—pipe

The invention claimed is:

1. An agrochemical pre-dilution unit comprising: a mixing device (21) that receives water and agrochemical to be mixed, wherein the unit comprises (i) a first pump (18) having an outlet and an inlet for circulating water and agrochemical inside the mixing device to form a water and agrochemical mixture inside of the mixing device, (ii) a second pump (20) which communicates the mixing device (21) to an outlet pipe (S) for discharging the water and agrochemical mixture, and (iii) a third pump (19) having an inlet and an outlet, wherein the outlet is in communication with a top portion of at least one bulk container (2, 3, 4, 5) by a pipe (P) that is connected to at least one pipe ($Q_n$), and wherein the inlet of the third pump communicates with a source of water, and wherein each pipe ($Q_n$) includes a flow-interruption valve, wherein:

the at least one bulk container (2, 3, 4, 5) is in communication with the inlet of the first pump (18) by at least a first pipe (G, H, I, J), wherein the at least first pipe (G, H, I, J) includes a pressure sensor (14, 16, 17);

the outlet of the first pump (18) is in communication with the mixing device (21) by a pipe (L), to supply agrochemical from the at least one bulk container (2, 3, 4, 5) to said mixing device (21); and the unit comprises a Programmable Logical Central (PLC) that is placed in a PLC housing (9) to control addition of the agrochemical.

2. The agrochemical pre-dilution unit according to claim 1, characterized in that the unit comprises a pipe (N) which is a ramification of a pipe (P) that is in communication with a cover that is at the top part of the bulk container (2, 3, 4, 5).

3. The agrochemical pre-dilution unit according to claim 2, characterized in that pipe (N) is subdivided into pipes (N1, N2, N3) for cleaning of the at least one bulk container, wherein flow-interruption valves (24, 25, 26, 27) are provided-for each pipe (N1, N2, N3) and for the at least one bulk container, also with an injection valve for each.

4. The agrochemical pre-dilution unit according to claim 1, characterized by having a powdered-input bag (7) that communicates with the mixing device (21) through a pipe (r) of the agrochemical pre-dilution unit.

5. The agrochemical pre-dilution unit according to claim 4, characterized in that in the pipe (R) there is an interruption valve (23).

6. The agrochemical pre-dilution unit according to claim 4, characterized in that the powdered-input bag (7) is installed on a balance (6).

7. The agrochemical pre-dilution unit according to claim 1, characterized in that in the pipe (L) there is a flow-rate meter (22).

8. The agrochemical pre-dilution unit according to claim 1, characterized in that the inlet of the first pump (18) is connected to a pipe (M) that receives water from the third pump (19).

* * * * *